US007971431B2

(12) United States Patent
Diez et al.

(10) Patent No.: US 7,971,431 B2
(45) Date of Patent: Jul. 5, 2011

(54) EXHAUST GAS SYSTEM

(75) Inventors: Rainer Diez, Nagold (DE); Marcus Ramusch, Altensteig-Spielberg (DE); Ramazan Sahan, Pfalzgrafenweiler-Boesingen (DE); Werner Verdoorn, Fuerstenfeldbruck (DE)

(73) Assignee: Friedrich Boysen GmbH & Co. KG, Altensteig (DE)

( * ) Notice: Subject to any disclaimer, the term of this patent is extended or adjusted under 35 U.S.C. 154(b) by 649 days.

(21) Appl. No.: 12/124,701

(22) Filed: May 21, 2008

(65) Prior Publication Data

US 2008/0289323 A1 Nov. 27, 2008

(30) Foreign Application Priority Data

May 21, 2007 (DE) ..... 10 2007 023 545

(51) Int. Cl.
*F01N 1/00* (2006.01)

(52) U.S. Cl. ..... 60/323; 60/322

(58) Field of Classification Search ..... 60/322, 60/323

See application file for complete search history.

(56) References Cited

U.S. PATENT DOCUMENTS 2,688,501 A * 9/1954 Macleod ..... 285/145.1
3,177,649 A * 4/1965 Tromel ..... 60/322
4,662,173 A * 5/1987 Wilkinson ..... 60/313
2006/0277902 A1* 12/2006 Williams et al. ..... 60/323
2010/0040465 A1* 2/2010 Moran et al. ..... 415/213.1

FOREIGN PATENT DOCUMENTS

DE 934 854 11/1955
DE 34 27 746 A1 1/1986
EP 0 172 401 B1 2/1989

* cited by examiner

*Primary Examiner* — Thomas E Denion
*Assistant Examiner* — Patrick Maines
(74) *Attorney, Agent, or Firm* — Fitch Even Tabin & Flannery

(57) ABSTRACT

An exhaust gas system for an internal combustion engine, in particular a motor vehicle engine, is provided having, in one form, two cylinder banks arranged at an acute angle to one anther and each having at least one exhaust gas outlet, a so-called V-engine, having exhaust gas guide elements arranged in the region of the inner angle, including a housing surrounding the exhaust gas outlets of both cylinder banks in a gas tight manner and having at least one exhaust gas outlet opening is characterized in that the housing is made in two parts, with a first part which is connected to the one cylinder bank and surrounds its exhaust gas outlets and with a second part which is connected to the other cylinder bank and surrounds its exhaust gas outlets; in that the two parts each have a side facing the other part and having at least one housing opening via which the two parts communicate with one another; and in that an expansion compensation element is arranged between the two parts and surrounds the housing opening of the two parts in a gas tight manner.

15 Claims, 3 Drawing Sheets

EXHAUST GAS SYSTEM

FIELD OF THE INVENTION

The present invention relates to an exhaust gas system for an internal combustion engine, in particular a motor vehicle engine, having two cylinder banks arranged at an acute angle to one anther and each having at least one exhaust gas outlet, a so-called V-engine, having exhaust gas guide elements arranged in the region of the inner angle, including a housing surrounding the exhaust gas outlets of both cylinder banks in a gas tight manner and having at least one exhaust gas outlet opening.

BACKGROUND OF THE INVENTION

The exhaust gas system serves for the leading away of the hot combustion gases arising in the internal combustion engine and is flanged directly to the corresponding outlets of the internal combustion engine. The housing surrounds the outlets of both cylinder banks in a gas tight manner. A connection is thereby possible between the outlets of the one cylinder bank and the outlets of the other cylinder bank in order also to enable crosstalk between the cylinder rows and thus an optimum load behavior. During operation, the hot combustion gases flowing out of the outlets cause a thermal expansion of the exhaust gas guidance elements which can amount to a plurality of millimeters in the region of the inner angle. The spacing between the cylinder banks can furthermore change slightly due to the operation-induced heating of the internal combustion engine. These thermal expansions cause unwanted strains due to the rigid connection of the exhaust gas guidance elements and said strains can put a great load on the flange fastening and/or on the exhaust gas guidance elements which cannot be compensated due to the rigidity of the engine block.

SUMMARY OF THE INVENTION

It is therefore the object of the present invention to provide an exhaust gas system of the initially named kind in which strains caused by thermal expansion are reduced.

This object is satisfied by an exhaust gas system having the features of as described hereinafter. The exhaust gas system in accordance with the invention is characterized in that the housing is made in two parts, with a first part which is connected to the one cylinder bank and surrounds its exhaust gas outlets and with a second part which is connected to the other cylinder bank and surrounds its exhaust gas outlets; in that the two parts each have a side facing the other part and having at least one housing opening via which the two parts communicate with to one another; and in that an expansion compensation element is arranged between the two parts which surrounds the housing opening of the two parts in a gas tight manner.

The two-part embodiment of the housing with an expansion compensation arranged therebetween effects a high deformability of the housing and thus enables a length compensation for the thermal expansion of the exhaust gas elements caused by the hot exhaust gases flowing through and enables the relative movement of the two cylinder banks of the V-engine with a simultaneously simple design and high gas tightness.

In a preferred embodiment of the invention, the two housing parts receive exhaust manifold pipes which are arranged spaced apart from the inner housing wall and whose respective one end is connected to an exhaust outlet of a cylinder bank and whose respective other end is connected to a continuing exhaust pipe, to an exhaust gas collection device or to another exhaust manifold pipe. With such an arrangement, which is also called an air-gap manifold, an insulation gap is formed by the spacing of the exhaust manifold pipes from the inner housing wall through which exhaust gases do not flow. Due to this double-wall formation, a thermal insulation with respect to the engine space is formed, on the one hand, and the premature cooling of the exhaust gas is thereby prevented, on the other hand, so that it can enter into a downstream exhaust gas purification system at a relatively high temperature. The total effect of the exhaust gas purification system is hereby improved and its response time cut.

Advantageously, the connection sites to the continuing exhaust pipe, to the other exhaust manifold pipe and/or to the exhaust gas collection device and/or to the exhaust gas collection devices are each arranged within one of the two housing parts. The transition region between the two housing parts, in particular the region of the thermal compensation element and of the housing openings is thereby kept free of connection sites and/or of exhaust gas collection devices and can have a relatively compact design.

In a preferred embodiment of the invention, the exhaust manifold pipes have a sliding seat connection at least at their one end. Such sliding seat connections also effect a compensation of the thermal expansion, and thus a reduction of strains, on the inner piping including the exhaust manifold pipes and the exhaust gas collection device.

At least one exhaust manifold pipe is preferably guided through the housing openings arranged in the sides of the two housing parts facing one another. It is thereby possible to guide an exhaust manifold pipe from one housing part to the other housing part and to joint it there, for example, to another exhaust manifold pipe or an exhaust gas collection device.

In an advantageous embodiment of the invention, at least one exhaust manifold pipe of a cylinder bank is connected to at least one exhaust manifold pipe of the other cylinder bank or to a common exhaust gas collection device. An interaction of the exhaust gas outlets between two cylinder banks, so-called crosstalk, can thereby be achieved, in particular to influence the load behavior of the interconnected cylinders to increase the performance of the internal combustion engine.

The mutually facing sides of the two housing parts are preferably each formed as housing bases in which at least one passage opening is provided for the connection of the interior of the two housing parts. The two mutually facing housing bases simplify the arrangement of the expansion compensation element.

In an advantageous embodiment of the invention, the expansion compensation element is made in the manner of a pair of bellows. Such a pair of bellows enables a gas tight connection of the two housing parts and additionally not only a length compensation in the direction of the passage openings, i.e. perpendicular to the housing bases, but also, to a certain degree, a movement of the housing parts parallel to the housing bases.

In an advantageous embodiment of the invention, the expansion compensation element is made of metal material. A sufficient heat resistance and service life of the expansion compensation element is hereby ensured.

Each housing part preferably has an exhaust gas outlet opening. A largely symmetrical construction of the exhaust gas system is thereby made possible.

At least one exhaust tract is advantageously guided through each of the two exhaust gas outlet openings. It is thereby possible to continue the exhaust gas system using two or more exhaust tracts.

In a preferred embodiment of the invention, the exhaust gas tracts are each guided up to one of two downstream exhaust gas turbochargers. The two turbochargers can thus be supplied with exhaust gas separately from specific cylinders.

In a further advantageous embodiment of the invention, a respective exhaust gas outlet of a cylinder bank is joined to an exhaust gas outlet of the other cylinder bank. Advantageous crosstalk between two cylinders of different cylinder banks can hereby be realized.

The exhaust gas paths from the respective exhaust gas outlet up to the joining together are preferably each at least approximately of the same length. A crosstalk effect approximately the same for all cylinders is thereby effected.

In another advantageous embodiment of the invention, the combined exhaust gas flows are guided separately from the other exhaust gas outlets up to a following element of the exhaust tract, in particular to a downstream turbocharger. The flow behavior of the exhaust gas flows is hereby improved and the crosstalk is largely restricted to the exhaust gas outlets directly connected to one another.

BRIEF DESCRIPTION OF THE DRAWINGS

Further preferred embodiments of the invention result from the drawing and the following description of an embodiment. There are shown in the drawing.

DETAILED DESCRIPTION OF THE PREFERRED EMBODIMENTS

Figure 1:
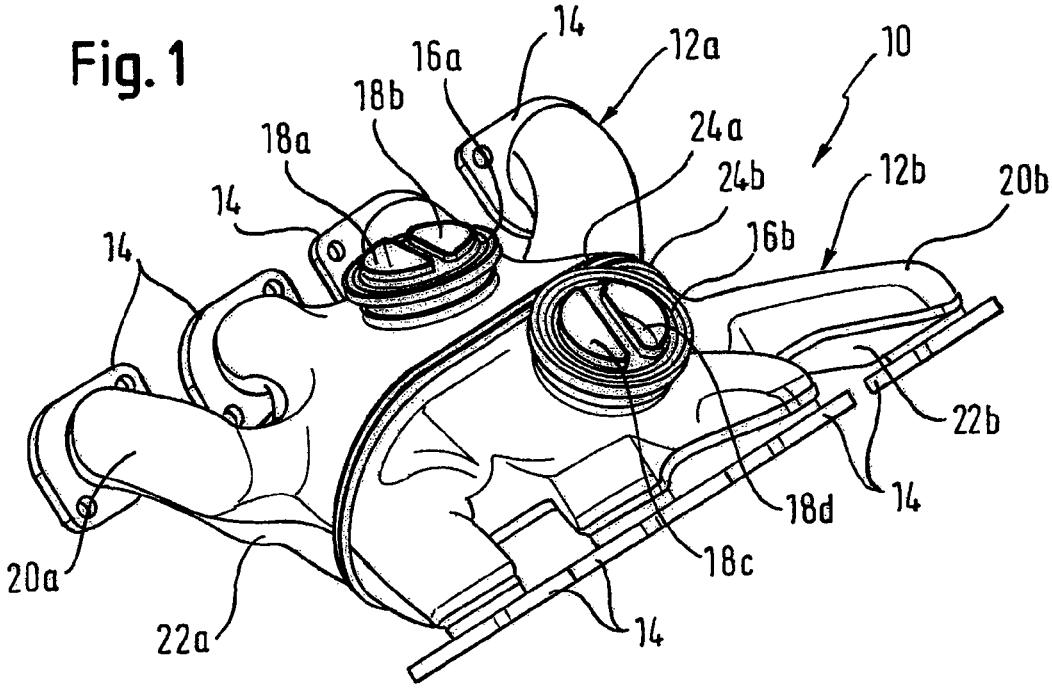
FIG. 1 a perspective view of a housing of an exhaust gas system in accordance with the present invention.
Figure 2:
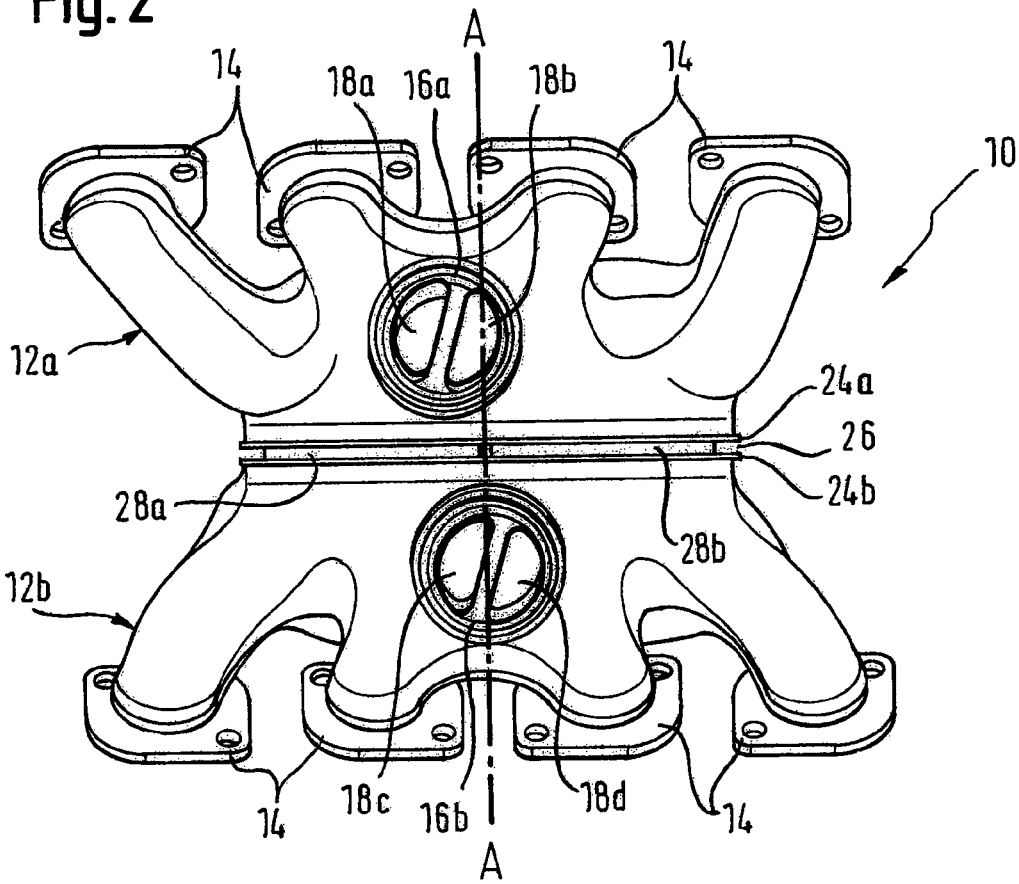
FIG. 2 a front view of the housing of FIG. 1.

FIGS. 1 and 2 show a housing 10 of an exhaust gas system in accordance with the invention for an internal combustion engine which has two cylinder banks which are not shown here, which are arranged at an acute angle to one another and which each have four exhaust gas outlets. The housing 10 includes two housing parts 12*a*, 12*b* of which each one respectively includes four flanges 14 arranged in a row for the connection to the exhaust gas outlets of a cylinder bank. The two rows of flanges 14 accordingly face in opposite directions.

Each housing part 12*a*, 12*b* has an exhaust gas outlet opening 16*a* and 16*b* respectively which is provided for connection to following elements, not shown, of the exhaust gas system, for example to an exhaust gas turbocharger or to an exhaust gas purification system. Two exhaust gas collection devices 18*a*, 18*b* and 18*c*, 18*c* respectively, which are arranged mainly in the interior of the housing parts 12*a*, 12*b* and which are in turn connected to exhaust manifold pipes not visible in FIGS. 1 and 2, respectively open in the exhaust gas outlet openings 16*a*, 16*b*. The arrangement of this internal piping will be explained in more detail in the following.

As can be recognized in FIG. 1, the housing parts 12*a*, 12*b* are each made in multiple parts. They each include one upper housing part 20*a* and 20*b* respectively having the exhaust gas outlet openings 16*a* and 16*b* and one lower housing part 22*a* and 22*b*.

Furthermore, each housing part 12*a*, 12*b* has a house base 24*a* and 24*b* respectively. The two housing bases 24*a*, 24*b* are arranged parallel to one another and, as can be recognized in FIG. 2, are arranged spaced apart from one another by a gap 26.

Two laterally mutually spaced apart expansion compensation elements 28*a*, 28*b* are arranged in the region of the gap 26 between the housing bases 24*a*, 24*b*. They each surround respective housing openings 30*a*, 30*b* which are made in the oval housing bases 24*b* in accordance with FIG. 3.

The housing base 24*a* of the other housing part 12*a* likewise has two such housing openings (not shown) and the expansion compensation elements 28*a*, 28*b* each connect two mutually oppositely disposed housing openings in the housing bases 24*a*, 24*b* to one another.

Two respective exhaust manifold pipes 32*b*, 32*c* and 32, 32*d* respectively are led through each housing opening 30*a*, 30*b* of the housing part 12*b* to the housing part 12*a*.

At the housing part, 12*a*, the upper housing part 20*a*, the lower housing part 22*a*, the housing base 24*a* and the four flanges 14 are connected to one another in a gas tight manner. The upper housing part 20*b*, the lower housing part 22*b*, the housing base 24*b* and the flanges 14 are accordingly also connected to one another in a gas tight manner in the second housing part 12*b*. The expansion compensation elements 28*a*, 28*b* are in turn connected to the housing bases 24*a*, 24*b* in a gas tight manner so that the housing 10 formed therefrom surrounds the exhaust manifold pipes 32*a* to 32*d* and exhaust gas collection devices 18*a* to 18*d* disposed inside it in the manner of an air-gap manifold in an air tight manner, with the gas-tight connections in particular being able to be designed as weld connections.

A simple manufacture is possible by the multi-part construction of the housing parts 12*a*, 12*b* despite a relatively complicated arrangement of the exhaust manifold pipes in the interior of the housing 10.

Figure 4:
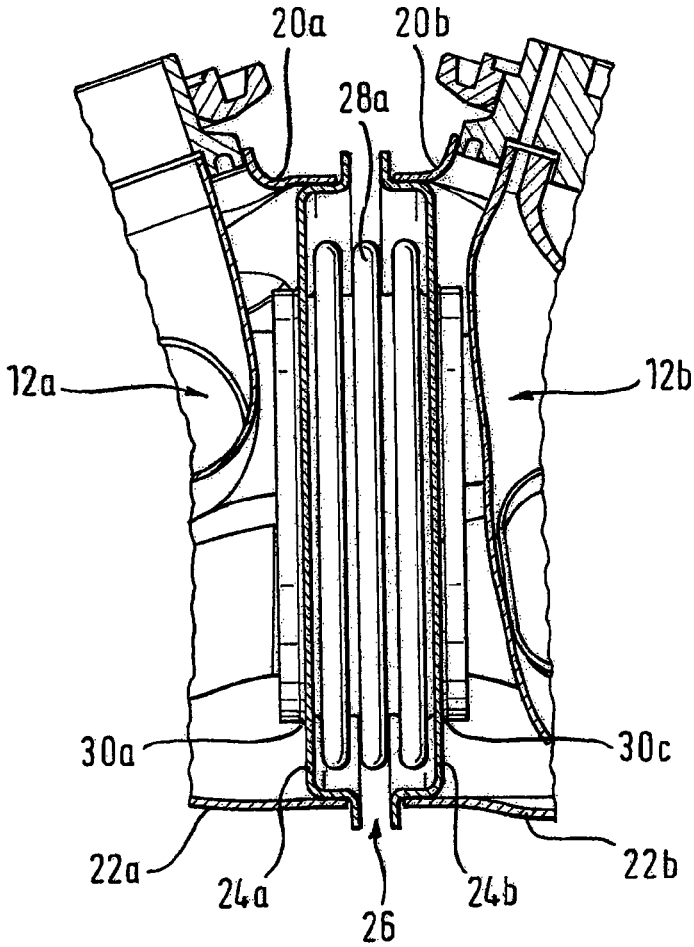
FIG. 4 a partial sectional view through the housing of FIGS. 1 and 2 along the line A-A in FIG. 2.

The arrangement of the expansion compensation elements 28*a*, 28*b* between the housing bases 24*a*, 24*b* will be explained in more detail with reference to FIG. 4. The housing bases 24*a*, 24*b* each have a center section which includes the housing openings 30*a*, 30*c* and which is set back in the direction of the interior of the housing part with respect to a marginal section. The gap 26 between the two housing parts 12*a*, 12*b* is thereby enlarged in the region of the housing openings 30*a*, 30*c* to provide sufficient space for the reception of the expansion compensation elements 28*a*.

The expansion compensation element 28*a* has the form of a short piece of pipe which is made in the manner of a pair of bellows or a corrugated pipe with three protuberances of metal material and which is inserted into the housing openings 30*a*, 30*c*. Due to its design similar to a corrugated pipe, the expansion compensation element 28*a* enables relative movements of the housing parts 12*a*, 12*b* to one another to a certain degree in both perpendicular and parallel directions with respect to the housing bases 24*a*, 24*b*. It is thereby possible to compensate the thermal expansions of the housing parts 12*a*, 12*b* caused by the hot exhaust gases as well as the deformations of the cylinder head of the V-engine and thus to reduce strains occurring between them.

Figure 5:
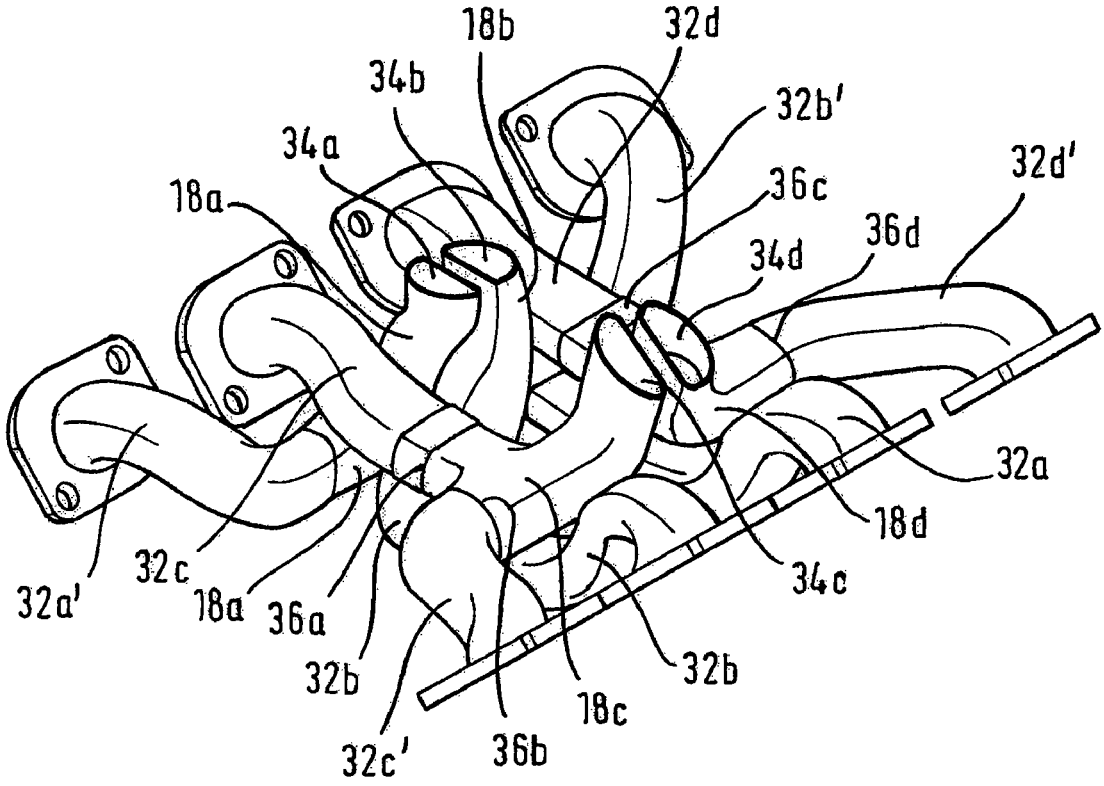
FIG. 5 a perspective view of the exhaust manifold pipes arranged in the housing of FIGS. 1 and 2.

The inner piping arranged inside the housing 10 shown in FIGS. 1 and 2 will now be explained with reference to FIG. 5. As was already described with reference to FIGS. 1 and 2, the manifold arrangement includes four exhaust gas collection devices 18*a* to 18*d*, with the exhaust gas collection devices 18*a*, 18*b* being arranged in the inside of the housing parts 12*a* and the exhaust gas collection devices 18*c*, 18 being arranged in the inside of the housing part 18*b*.

Each exhaust gas collection device 18*a* to 18*d* has three branches of which a respective one is a outlet branch 34*a* 34*d*.

The outlet branches 34*a* and 34*b* or 34*c* and 34*d* respectively are combined in pairs and are guided in accordance with FIGS. 1 and 2 through the exhaust gas outlet openings 16*a* and 16*b* respectively of the two housing parts 12*a*, 12*b*. In order to be able to utilize the cross-section area preset by the circular form of the exhaust gas outlet openings 16*a*, 16*b* ideally, the outlet branches 34*a* to 34*d* have a substantially semi-circular cross-section at least in their end region.

The two other branches of the exhaust gas collection device 18*a* to 18*d* are made as inlet branches an are each connected to one end of an exhaust manifold pipe 32*a* to *d*, 32*a*'to *d*'. An exhaust manifold pipe associated with the one cylinder bank is always connected via a specific exhaust gas collection device to an exhaust manifold pipe associated with the other cylinder bank.

The exhaust gas collection device 18*c* recognizable in the foreground is thus connected to the exhaust manifold pipes 32*c*, 32*c*'. As can be recognized equally easily, the exhaust gas collection device 18*d* is connected to the exhaust manifold pipes 32, 32*d*'. The exhaust gas collection device 18*a* is furthermore connected to the exhaust manifold pipes 32*a*, 32*a*' and the exhaust gas collection device 18*b* is connected to the exhaust manifold pipes 32*b*, 32*b*'.

Exhaust manifold pipes and exhaust gas collection devices are connected to one another with a sliding seat for expansion compensation. In FIG. 5, sliding seat connections 36*a* and 36*b* respectively are in particular present between the exhaust manifold pipes 32*c* and 32*c*' respectively and the exhaust gas collection device 18*c* and sliding seat connections 36*c* and 36*d* respectively are present between the exhaust manifold pipes 32*d* and 32*dc*' respectively and the exhaust gas collection device 18*d*.

The piping is selected such that in each case the outlets connected to a common exhaust gas collection device 18*a* to *d* are associated with filters which ignite at a desired interval from one another. Crosstalk between the two cylinder banks is achieved by this type of the connection of the two cylinder banks and enables a high performance improvement of the internal combustion engine. It is effected by a suitable pipe design and pipe guidance that the exhaust gas paths from the respective exhaust gas outlet up to the joining together are at least approximately each equally long, whereby the coordination is further improved.

Figure 3:
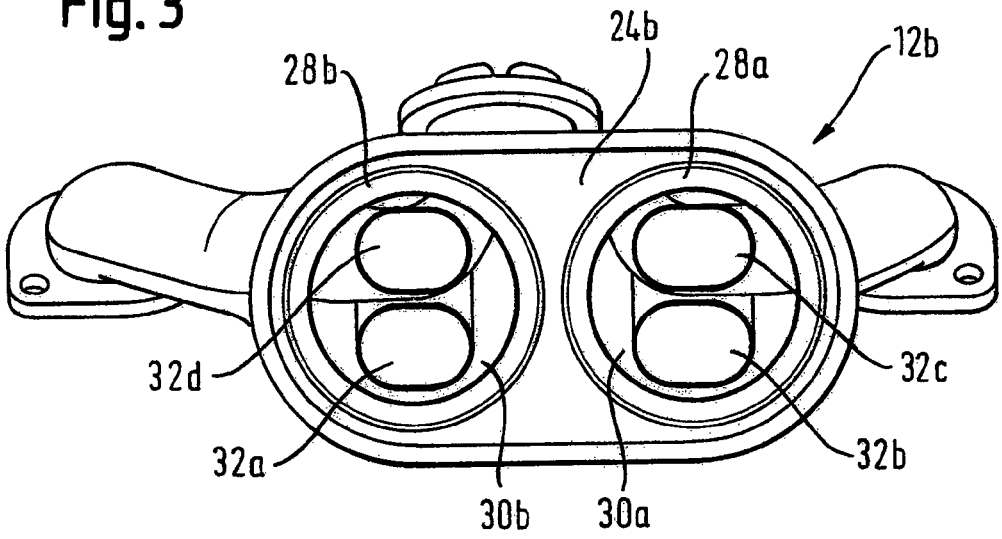
FIG. 3 a side view of a housing part of the housing of FIGS. 1 and 2.

As is also shown in FIG. 3, the exhaust manifold pipes 32*a* to 33*d* extend through the expansion compensation elements 28*a*, 28*b*, with the exhaust manifold pipes 32*a*, 32*d* being guided by the expansion compensation element 28*b* and the exhaust manifold pipes 32*b* and 32*c* being guided by the expansion compensation element 28*a*. The expansion compensation elements 28*a*, 28*b* are made in very compact form since they only have to receive throughgoing, straight sections of the exhaust manifold pipes 32*a* to 32*d*.

The exhaust gas collection devices 18*a*, 18*b* as well as the exhaust manifold pipes 32*a*', 32*b*' connected to them are located in the housing part 12*a*, whereas the exhaust collection devices 18*c*, 18*d* and the exhaust manifold pipes 32*c*', 32*d*' connected to them are arranged in the housing part 12*b*.

The arrangement described in the aforesaid embodiment accordingly has a very compact form overall and is at the same time simple in manufacture despite the relatively complicated piping required for the crosstalk between the cylinder banks.

Provision is preferably made to arrange the exhaust gas outlet openings 16*a*, 16*b* in each case after an exhaust gas turbocharger. In this connection, the outlet branches 34*a* , 34*b* and 34*c*, 34*d* are each continued in two flutes up to the charger. It is, however, also possible to join them via further collection devices and to continue them in one flute up to the exhaust gas turbochargers.

What is claimed is:

1. An exhaust system for an internal combustion engine, in particular for a motor vehicle engine, having two cylinder banks arranged at an acute angle to one another and each having at least one exhaust gas outlet, a V-engine, having exhaust gas guide elements arranged in an region of the inner angle, including a housing (10) surrounding the exhaust gas outlets of both cylinder banks in a gas tight manner and having at least one exhaust gas outlet opening (16*a*, 16*b*), characterized in that the housing (10) is made in two parts, with a first part (12*a*) which is connected to the one cylinder bank and surrounds its exhaust gas outlets and with a second part (12*b*) which is connected to the other cylinder bank and surrounds its exhaust gas outlets; in that the two parts (12*a*, 12*b*) each have a side (24*a*, 24*b*) facing the other part and having at least one housing opening (30*a*-30*c*) via which the two parts (12*a*, 12*b*) communicate with one another; and in that an expansion compensation element (28*a*, 28*b*) is arranged between the two parts (12*a*, 12*b*) which surrounds the housing openings (30*a*-30*c*) of the two parts (12*a*, 12*b*) in a gas tight manner.

2. An exhaust gas system in accordance with claim 1, characterized in that the two housing parts (12*a*, 12*b*) receive exhaust manifold pipes (32*a*-32*d*, 32*a*'-32*d*') which are arranged spaced apart from the inner housing wall and whose respective one end is connected to an exhaust outlet of a cylinder bank and whose respective other end is connected to a continuing exhaust pipe, to an exhaust gas collection device (18*a*-18*d*) or to another exhaust manifold pipe (32*a*-32*d*, 32*a*'-32*d*').

3. An exhaust gas system in accordance with claim 2, characterized in that the connection sites are connected to the continuing exhaust pipe, to the other exhaust manifold pipe (32*a*-32*d*, 32*a*'-32*d*') at least one of to the exhaust gas collection device (18*a*-18*d*) at least one of the exhaust gas collection devices (18*a*-18*d*) are each arranged within one of the two housing parts.

4. An exhaust gas system in accordance with claim 2, characterized in that the exhaust manifold pipes (32*a*-32*d*, 32*a*'-32*d*') have a sliding seat connection (36*a*-36*d*) at least at their one end.

5. An exhaust gas system in accordance with claim 1, characterized in that at least one exhaust manifold pipe (32*a*-32*d*) is guided through the housing openings (30*a*-30*c*) arranged in the mutually facing sides (24*a*, 24*b*) of the two housing parts (12*a*, 12*b*).

6. An exhaust gas system in accordance with claim 1, characterized in that at least one exhaust manifold pipe (32*a*-32*d*, 32*a*'-32*d*') of a cylinder bank are connected to at least one exhaust manifold pipe (32*a*'-32*d*') of the other cylinder bank or to a common exhaust gas collection device (18*a*-18*d*).

7. An exhaust gas system in accordance with claim 1, characterized in that the mutually facing sides of the two housing parts (12*a*, 12*b*) are each made as housing bases (24*a*, 24*b*) in which at least one passage opening (30*a*-30*c*) is provided for the connection of the interior of the two housing parts (12*a*, 12*b*).

8. An exhaust gas system in accordance with claim 1, characterized in that the expansion compensation element (28*a*, 28*b*) is designed in the manner of a pair of bellows.

9. An exhaust gas system in accordance with claim 1, characterized in that the expansion compensation element (28*a*, 28*b*) is made of metal material.

10. An exhaust gas system in accordance with claim 1, characterized in that each housing part (12*a*, 12*b*) has an exhaust gas outlet opening (16*a*, 16*b*).

11. An exhaust gas system in accordance with claim 10, characterized in that at least one exhaust tract (34*a*-34*d*) is guided through each of the two exhaust outlet openings (16*a*, 16*b*).

12. An exhaust gas system in accordance with claim 11, characterized in that the exhaust tracts (34*a*-34*d*) are each guided up to one of two downstream exhaust gas turbochargers.

13. An exhaust gas system in accordance with claim 1, characterized in that in each case an exhaust gas outlet of a cylinder bank is joined to an exhaust gas outlet of the other cylinder bank.

14. An exhaust gas system in accordance with claim 13, characterized in that the exhaust gas paths from the respective exhaust gas outlet up to the joining together (18*a*-18*d*) are each at least approximately of the same length.

15. An exhaust gas system in accordance with claim 13, characterized in that the joined exhaust gas flows are guided separately from the other exhaust gas outlets up to a following element of the exhaust tract, in particular to a downstream turbocharger.

* * * * *

UNITED STATES PATENT AND TRADEMARK OFFICE

CERTIFICATE OF CORRECTION

PATENT NO. : 7,971,431 B2
APPLICATION NO. : 12/124701
DATED : July 5, 2011
INVENTOR(S) : Rainer Diez et al.

It is certified that error appears in the above-identified patent and that said Letters Patent is hereby corrected as shown below:

Title Page, col. 2, under Abstract (57), Line 4, delete “anther” and insert -- another --.

Signed and Sealed this
Thirteenth Day of September, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,971,431 B2
APPLICATION NO. : 12/124701
DATED : July 5, 2011
INVENTOR(S) : Rainer Diez et al.

It is certified that error appears in the above-identified patent and that said Letters Patent is hereby corrected as shown below:

On the Title Page:

(73) Assignee:

After Friedrich Boysen GmbH & Co. KG, Altensteig (DE), add

-- Bayerische Motoren Werke Aktiengesellschaft, Munich (DE) --.

Signed and Sealed this
Nineteenth Day of June, 2012

David J. Kappos

David J. Kappos
*Director of the United States Patent and Trademark Office*